US005205342A

United States Patent [19]

Eichler

[11] Patent Number: 5,205,342

[45] Date of Patent: Apr. 27, 1993

[54] CONTINUOUS SLAB CASTER ARRANGEMENT FOLLOWED BY A ROLLING MILL

[75] Inventor: Dietmar Eichler, Linz, Austria

[73] Assignee: Voest-Alpine Industrieanlagenbau G.m.b.H., Linz, Austria

[21] Appl. No.: 809,267

[22] Filed: Dec. 16, 1991

[30] Foreign Application Priority Data

Dec. 20, 1990 [AT] Austria ..... 2600/90

[51] Int. Cl.[5] .....B22D 11/12; B21B 1/46

[52] U.S. Cl. ..... 164/417; 164/476; 29/527.1; 414/198

[58] Field of Search ..... 164/476, 477, 417; 29/527.7; 266/252, 274; 414/172, 196, 198, 211

[56] References Cited

U.S. PATENT DOCUMENTS

| | | | |
|---|---|---|---|
| 3,567,195 | 3/1971 | Kakuta | 266/252 |
| 4,918,803 | 4/1990 | Di Gusto | 29/527.7 |
| 5,117,545 | 6/1992 | Di Gusto | 29/527.7 |

FOREIGN PATENT DOCUMENTS

| | | | |
|---|---|---|---|
| 0264459 | 10/1986 | European Pat. Off. . | |
| 3324487 | 1/1985 | Fed. Rep. of Germany . | |
| 3741220 | 6/1989 | Fed. Rep. of Germany | 29/527.7 |

*Primary Examiner*—Richard K. Seidel
*Assistant Examiner*—Erik R. Puknys
*Attorney, Agent, or Firm*—Hopgood, Calimafde, Kalil, Blaustein & Judlowe

[57] ABSTRACT

In a continuous casting plant for slabs with a consecutively arranged rolling mill, a furnace is provided between a strand separating device arranged at a run-out roller table of the continuous casting plant and the rolling mill. The furnace has a feed side, a delivery side and a transverse conveying device for conveying a slab from a longitudinal conveying device arranged on the feed side to a longitudinal conveying device arranged on the delivery side and including a slab storage place located parallel to the longitudinal conveying device. In order to enable the compact construction of the furnace and simple installations within the furnace, at least one fixed hearth having a minimum width adapted to a slab width is provided within the furnace parallel to the longitudinal conveying device. The transverse conveying device is formed by a lifting device projecting into the interior of the furnace through the furnace roof and displaceable from a position above the longitudinal conveying device into a position above the fixed hearth and vice versa.

17 Claims, 7 Drawing Sheets

CONTINUOUS SLAB CASTER ARRANGEMENT FOLLOWED BY A ROLLING MILL

The invention relates to a continuous casting plant for slabs, in particular a continuous casting plant for thin slabs, with a consecutively arranged rolling mill, wherein a furnace is provided between a strand separating means arranged at a run-out roller table of the continuous casting plant and the rolling mill, which furnace includes a feed side, a delivery side and a transverse conveying means for conveying a slab from a longitudinal conveying means arranged on the feed side to a longitudinal conveying means arranged on the delivery side and including a slab storage place located parallel to the longitudinal conveying means.

A plant of this type is known from DE-A - 37 41 220 and from EP-A - 0 264 459. With the plant known from the latter document, the furnace, which has a T-shaped cross section, comprises a horizontally oriented part and a vertically oriented part, wherein a transverse conveying means is provided in the horizontally oriented part, which offers several adjacently located slab storage spaces. In the vertical furnace part, a vertically displaceable shelve-like deposit including compartments for individual slabs is provided, in which several slabs can be stored in an emergency case, i.e., at a standstill of the rolling mill, such that the casting operation need not be interrupted.

This known plant is structurally complex and involves considerable investment costs, the more so as a vertically displaceable deposit is required which must be capable of simultaneously lifting and lowering all the slabs stored on this deposit. In addition, the transverse conveying means, the only way of realization of which in the known furnace is in the form of a walking beam system, implies intermittent discharging such that the residence time of a slab within the furnace merely depends on the conveying performance of the transverse conveying means and on the number of storage places at the same.

Additional disadvantages are to be seen in that the longitudinal conveying means is forced to cross the transverse conveying means and the lifting means for the vertically movable deposit. This involves complex structural components, rendering manipulations within the hot furnace accordingly difficult. Moreover, the furnace has a considerable transverse extension and a considerable height extension and, due to its T-shaped cross section, also a large surface to be insulated.

The invention aims at avoiding these disadvantages and difficulties and has as its object to provide a plant of the initially defined kind, in which the furnace is of a compact construction, i.e., in which the furnace has a slight transverse extension and a very slight height extension. In addition, the manipulation means for transversely conveying the slabs is to be used also for storing the slabs, no separate means thus being required therefor.

In accordance with the invention, this object is achieved in that at least one fixed hearth having a minimum width adapted to a slab width is provided within the furnace parallel to the longitudinal conveying means and that the transverse conveying means is comprised of a lifting means projecting into the interior of the furnace through the furnace roof and displaceable from a position above the longitudinal conveying means into a position above the fixed hearth and vice versa.

Thereby, the transverse conveying means may be employed both for depositing slabs on the fixed hearth and for conveying them from the fixed hearth to the delivery side, such a single transverse conveying means also being readily usable with a furnace having more than one feed side. In accordance with the invention, any slab manipulations within the furnace are feasible in a simple manner by aid of a single transverse conveying means, the furnace, thus, may be of an extremely compact construction.

Preferably, the fixed hearth is adapted to receive a plurality of slabs stacked one above the other. Thereby, many slabs can be stored in the furnace without calling for an enlargement of the furnace, which would require much space. It merely suffices to adjust the height of the furnace to the maximum storage capacity sought.

Suitably, the lifting means is equipped with grapplers distributedly arranged along the furnace length and engaging at the longitudinal edges of the slabs.

In order to avoid thermal losses and flame-out losses, the grapplers are sealed relative to the furnace roof by a liquid seal in a manner known per se.

To save the grapplers, the grapplers, in the resting position, advantageously are retractable into a recess provided in the furnace roof, which recess constituting the resting position of the grapplers suitably is delimited by a coolant jacket.

A preferred embodiment is characterized in that the grapplers each are enclosed by a sleeve provided above the furnace roof, which sleeve comprises a liquid seal on its upper end into which a bell engaging at the grappler is immersed and which sleeve, on its lower end, is tightly inserted in a sealing strip extending transverse to the sleeve, preferably a metal strip, which sealing strip extends in a displacement channel arranged along the moving path of the lifting means and, with its longitudinal side edge regions, abuts on supporting surfaces arranged in the longitudinal direction of the displacement channel and also extending transverse to the same on the ends of the displacement channel, and is pressed at the same by sealing ledges extending along the displacement channel and also transverse to the displacement channel on the end of the same, wherein the sealing strip is displaceable between the sealing ledges and the supporting surfaces during movement of the lifting means, the ends of the sealing strip each being windable on and off a drum.

Suitably, a further channel is provided below the displacement channel, including a central slit-shaped passage opening for the grapplers that serves to receive leaking liquid.

A particularly advantageous embodiment, which is hardly prone to failures even at high furnace temperatures, is characterized in that the longitudinal conveying means are comprised of double walking beam conveying means, the double walking beam conveying means suitably being equipped with internally cooled supporting members projecting into the furnace interior.

In order to be able to safely convey even narrow thin slabs and to prevent the ends of a thin slab from hanging down, the supporting members advantageously extend transverse to the transport direction over approximately the total slab width and are provided with projections extending in the transport direction, each of which projections engage between projections of the neighboring supporting member as the supporting members approach each other.

For conveying particularly slim thin slabs, the supporting members extend in the conveying direction and are equipped with enlargements provided transverse to the transport direction, enlargements provided between neighboring supporting members being spaced apart.

In order to prevent a slab seized by the lifting means from falling down when conveyed transversely, securing hooks are hinged to the grapplers according to a preferred embodiment, which securing hooks assume a resting position with the grapplers being in a position free in space, in which the hook ends reach below the jaws of the grapplers seizing the longitudinal edges of the slabs and slightly engage at the same from below, the articulation of the securing hooks advantageously being realized by a linkage parallelogram whose web is formed by a grappler and whose coupler is formed by a securing hook.

In order to carefully introduce into the grapplers the forces occurring if a hook is loaded with a slab, the securing hooks suitably are equipped with supporting noses each engaging in a corresponding recess provided in the grappler in the resting position of a securing hook, wherein a surface of the recess engaging at the securing hook and absorbing vertical forces contacts a corresponding supporting surface of the supporting nose.

In order to prevent the slabs from sagging, the longitudinal conveying means and the fixed hearth, in the transverse direction, advantageously are equipped with upwardly curved slab supports.

With particularly long slabs or slabs having relatively low feeding temperatures, the furnace, on its feed side, suitably is provided with a preheating chamber following the transverse wall of the furnace in order to ensure that the rolling temperature also will be attained for the slab end fed at last.

A preferred embodiment is characterized in that the furnace has at least two feed sides each followed by a run-out roller table of a continuous caster, wherein a separate fixed hearth is provided for each feed side, while the furnace still has a single delivery side.

In the following, the invention will be explained in more detail by way of several exemplary embodiments illustrated in the drawing, wherein.

Figure 1:
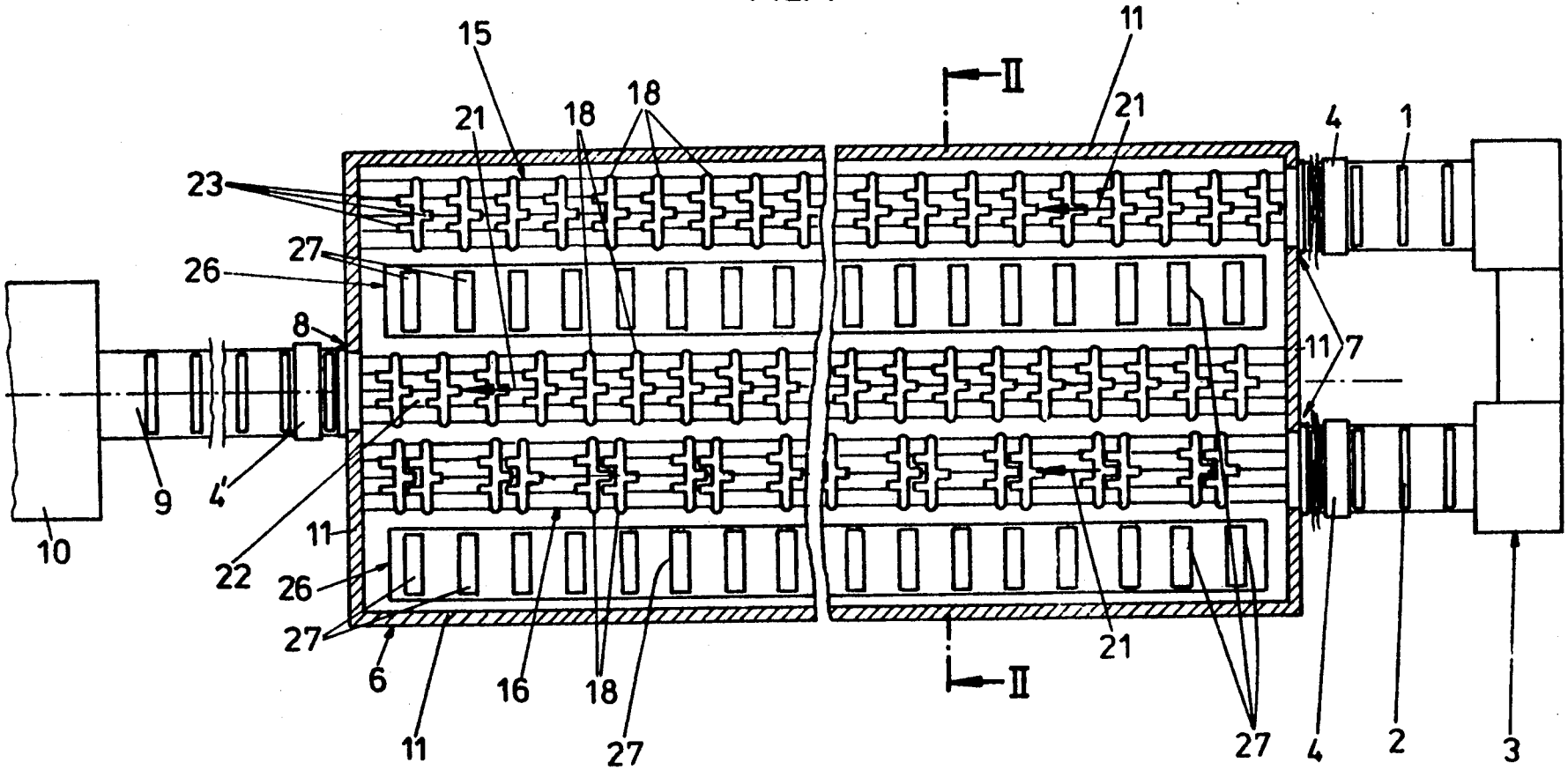
FIG. 1 illustrates the ground plan of a plant of the invention according to a first embodiment.
Figure 3:
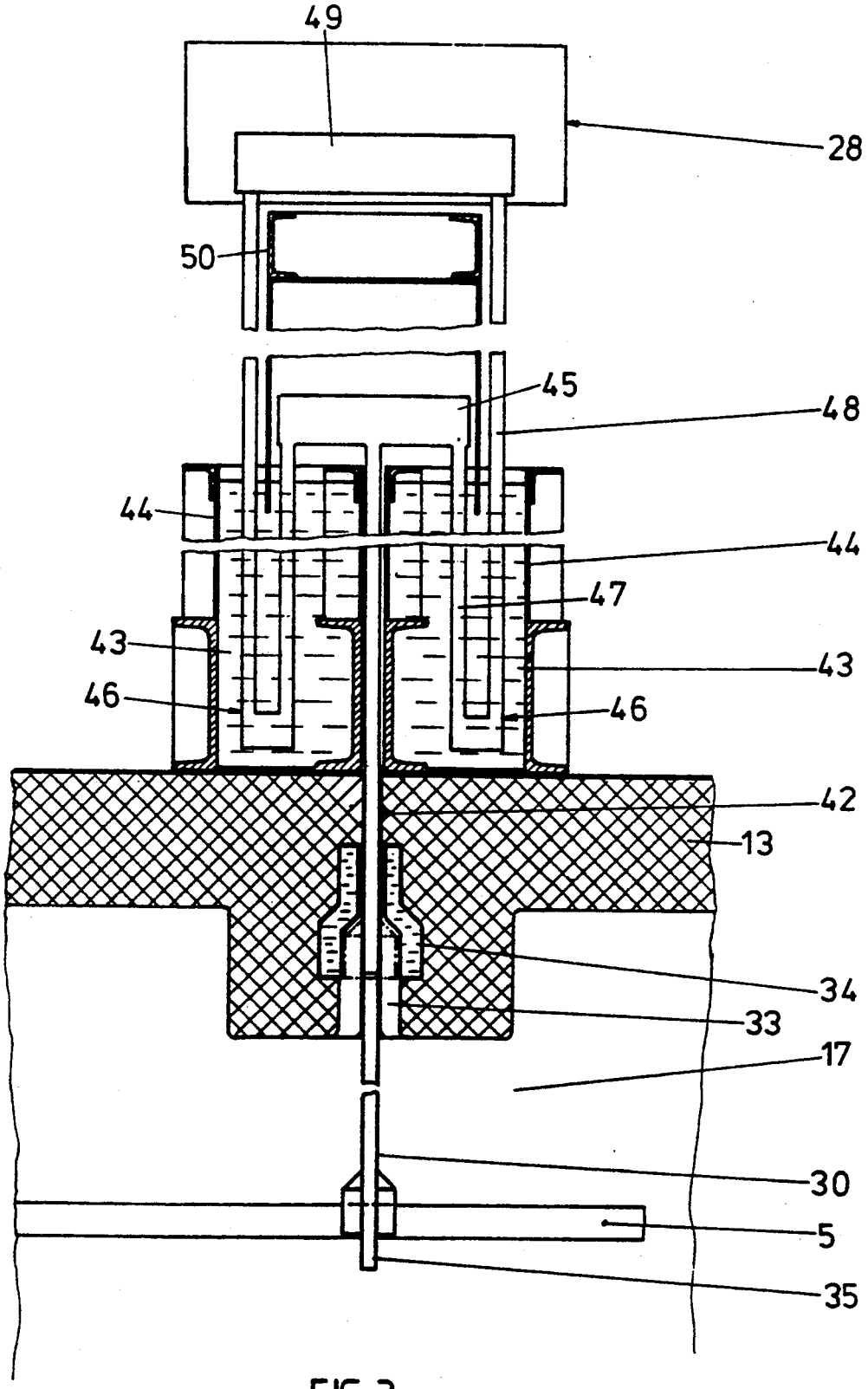
Figure 4:
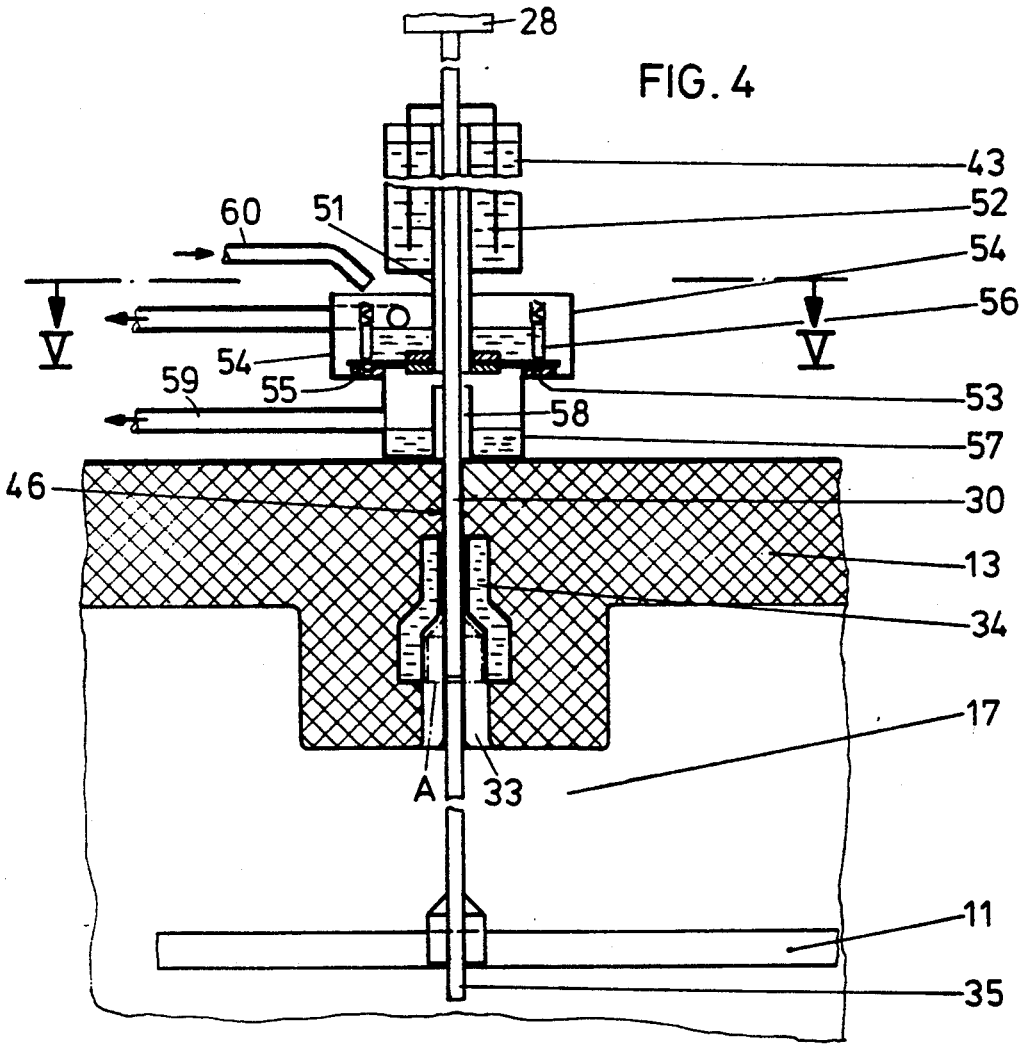
Figure 5:
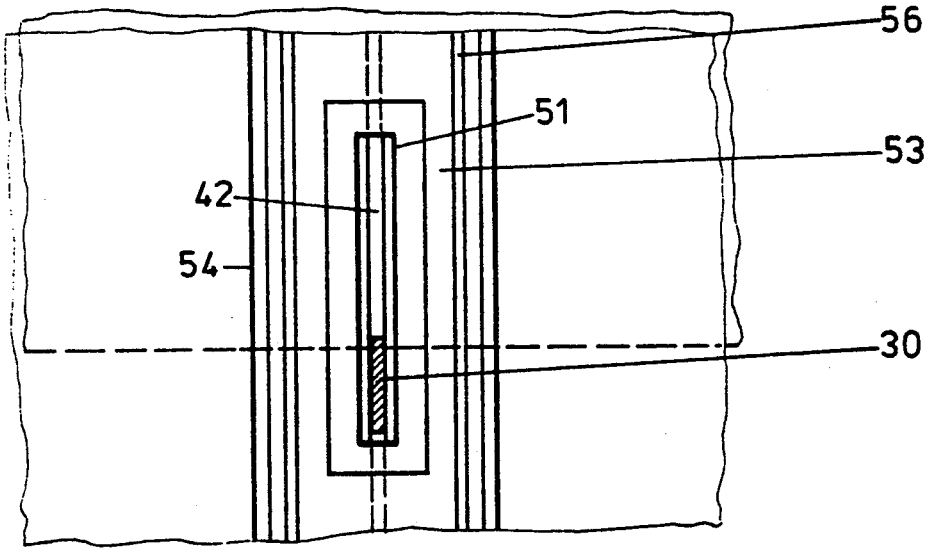
Figure 6:
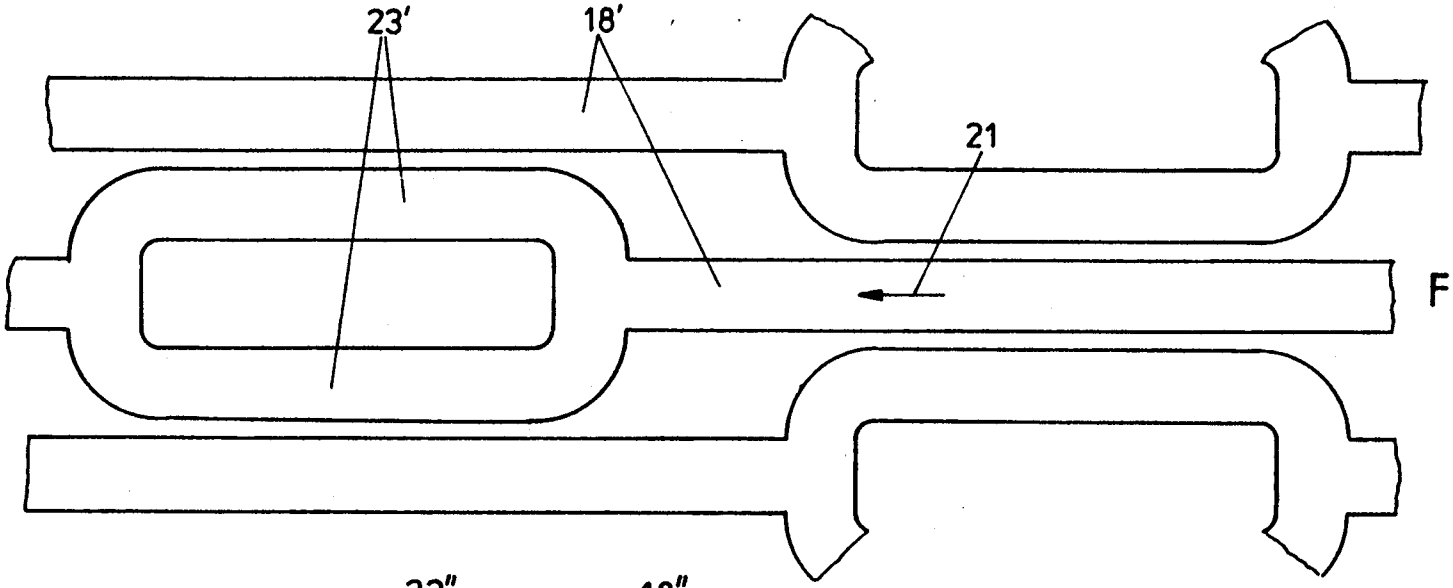
Figure 7:
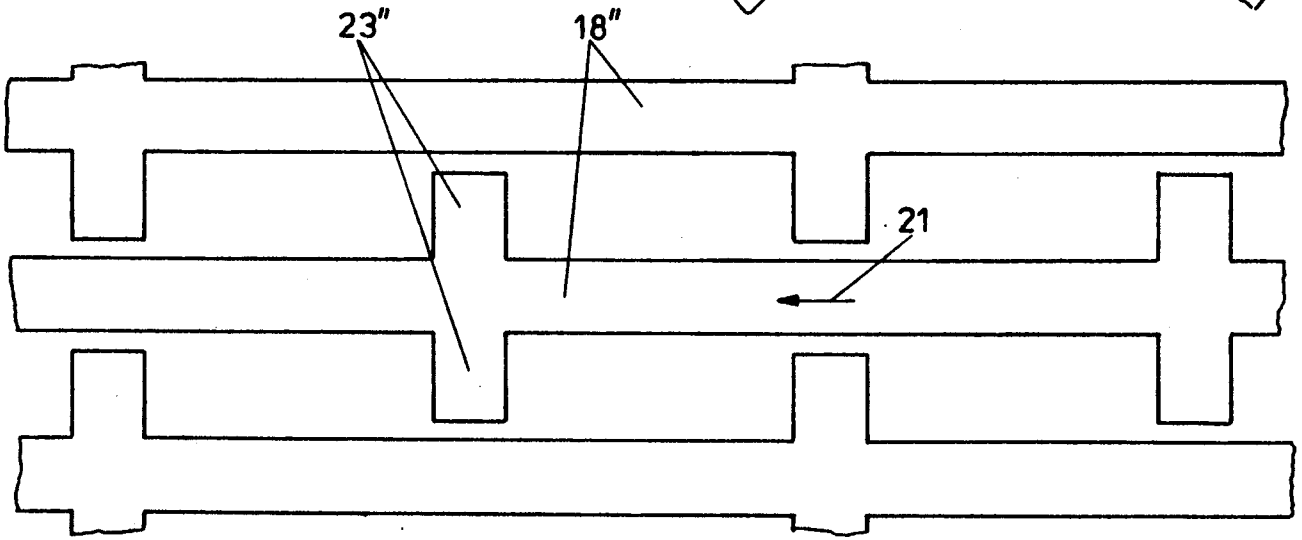
Figure 8:
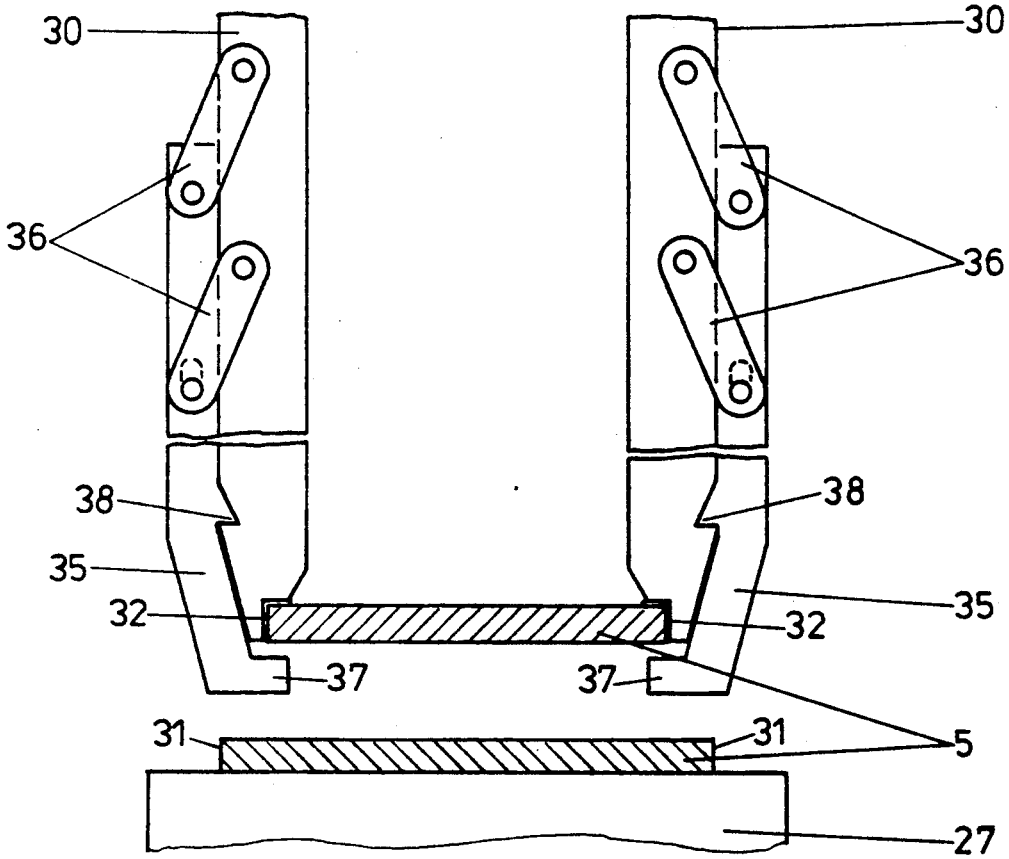
Figure 9:
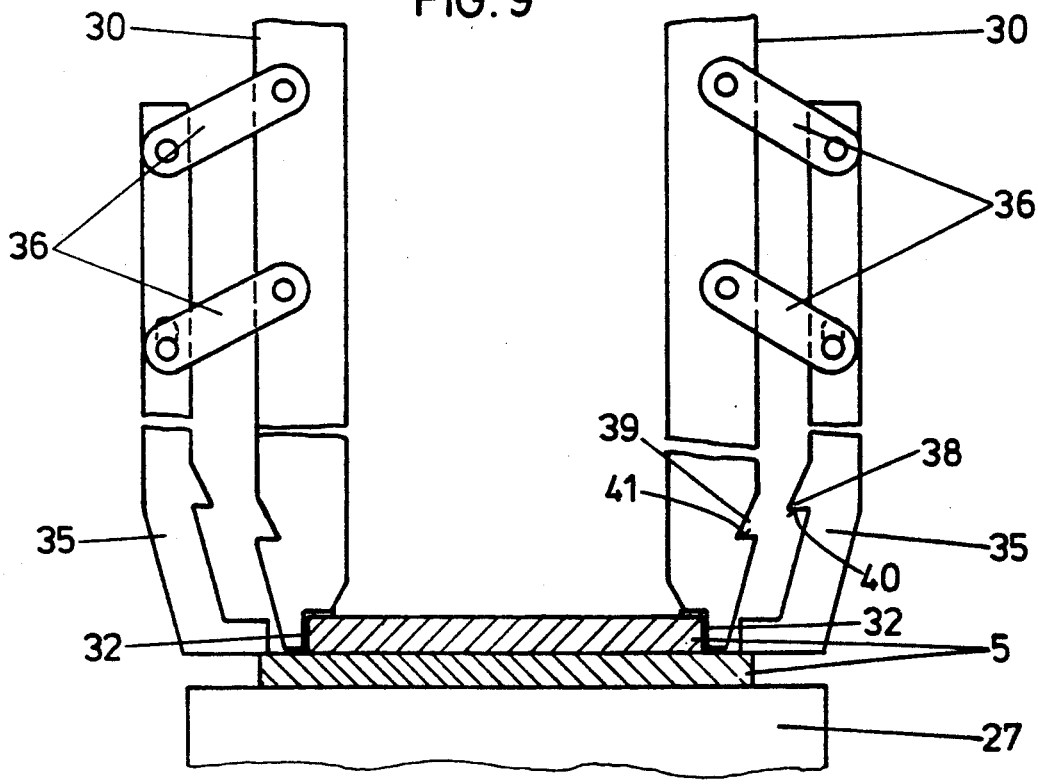
Figure 10:
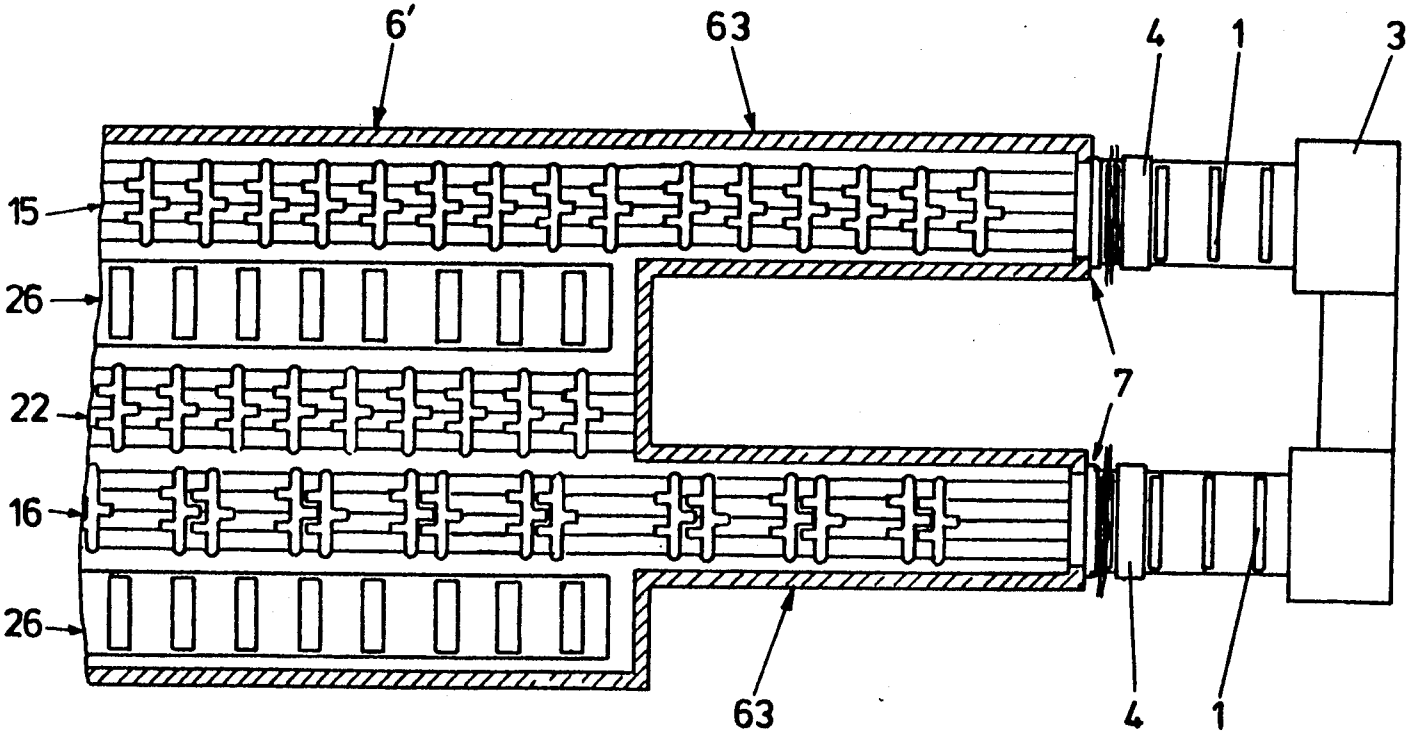

FIGS. 3 and 4 each represent details of the seal of the lifting means relative to the furnace roof in the furnace longitudinal section according to one embodiment each;

FIG. 5 illustrates a section along line V—V of FIG. 4;

FIGS. 6 and 7 are top views of details of the longitudinal conveying means of the plant according to the invention;

FIGS. 8 and 9 represent details of the lifting means, viewed in the longitudinal direction of the furnace; and FIG. 10 represents another embodiment in an illustration analogous to FIG. 1.

1 and 2 denote two run-out roller tables of a double strand caster 3, on whose ends separating means 4 are provided for separating the cast strand into slabs 5 of predetermined lengths, preferably into slabs 5 of equal length. The slabs are so-called "thin slabs", i.e., slabs having a thickness of up to 70 mm. However, the plant according to the invention also may be employed with normal slabs, i.e., slabs having thicknesses of 100 mm or more.

The thin slabs cut to length get from the run-out roller tables 1, 2, which they leave at a speed slightly exceeding the casting speed, for instance at 3 m/min, into a furnace 6 through its feed side 7, are homogenized in temperature and heated within the furnace 6 so as to exhibit the necessary rolling temperature at any point over their cross sections. The thin slabs leave the furnace 6 by its delivery side 8 and, via a roller table 9, are supplied to a consecutively arranged rolling mill 10 at rolling speed, for instance, at 12 m/min.

The furnace 6 has a length corresponding to the maximum slab length desired. This may be 30 to 50 m. The cross section of the furnace 6 is rectangular. The side walls 11, the bottom 12 and the roof 13 of the furnace are refractorily lined and, if desired, are heat-insulated. Burners 14 are provided in the longitudinal side walls 11, which are activated if the sensible heat of the slabs is below rolling temperature. These burners 14 also might be designed as roof burners; however, the furnace also could be equipped with an electric heating means.

On each feed side 7 of the furnace 6, a longitudinal conveying means 15, 16 follows immediately upon each run-out roller table 1, 2 of the continuous casting plant 3, which, as opposed to the prior art, are not designed as roller tables, but as walking beam conveying means. This has the advantage of avoiding pimples forming on rollers provided within the furnace, which would cause indentations on the supported side of the hot stock, thus impairing the surface quality of the end product. In addition, rollers provided within the furnace would have to be equipped with water cooling means because of the high furnace temperatures (rolling temperature), the removal of which for the purpose of removing the pimples would be elaborate.

According to the embodiment illustrated in FIG. 1, the walking beam conveying means is formed by supporting members 18 reaching into the furnace space 17 from below the bottom 12 of the furnace 6 and extending transverse to the longitudinal axis of the furnace. The supporting members 18 of each longitudinal conveying means 15, 16 are mounted on two walking beam systems 19, 20 extending in the longitudinal direction of the furnace. Each of the walking beam systems 19, 20 carries out a lifting and lowering movement as well as a movement in the conveying direction 21 and back. Every other supporting member 18 is mounted on one and the same walking beam system 19, 20 such that two groups of supporting members 18 are formed, which are separately lifted and lowered and are displaceable relative to each other in the longitudinal direction of the furnace 6, i.e., in the conveying direction 21 of the longitudinal conveying means 15, 16 in the lifted state and in the opposite direction in the lowered state. Hence results a continuously uniform progression of the thin slabs 5 resting on the supporting members 18. The supporting members 18 are guided through slot-shaped openings 12' of the furnace bottom 12. These openings 12' are sealed by liquid seals 12" against the penetration of false air into the furnace space 17.

The longitudinal conveying means 22 arranged downstream of the roller table 9 towards the rolling mill 10 on the delivery side 8 of the furnace 6 likewise is designed as a walking beam conveying means. Its supporting members 18 are movable independent of the supporting members 18 of the longitudinal conveying means 15, 16 located on the feed sides 7 such that the thin slabs 5, on the one hand, are introduced into the furnace 6 at a speed slightly exceeding the casting speed and, on the other hand, can be conveyed out of the furnace 6 at rolling speed, i.e., at tapping speed (on the delivery side 8).

According to the embodiment illustrated in FIG. 1; the supporting members 18 of all of the walking beam conveying means comprise projections 23 extending in the conveying direction 21 and opposite thereto. These projections 23, on which the thin slabs 5 also rest, engage each other in a comb-like manner as the supporting members 18 are relatively moved, so that a good support is offered to the thin slabs 5 and the end of a thin slab is unable to push against one of the supporting members 18. Moreover, the supporting members 18 are provided with an internal cooling 24 preferably designed as a liquid cooling, and comprise carriers of heat-resistant steel on their supporting sides.

A slightly modified embodiment of the supporting members is illustrated in FIGS. 6 and 7. With these variants, the supporting members 18', 18" do not extend transverse to the transport direction 21 like in FIG. 1, but they extend along the transport direction 21, i.e., parallel to the longitudinal extension of the furnace. This variant preferably is destined to transport particularly slim thin slabs 5. In order to ensure that the thin slabs 5 safely rest on these supporting members 18', 18", the oppositely movable supporting members 18', 18" of a walking beam system 15, 16 and 22, respectively, include enlargements 23', 23" oriented transverse to their longitudinal extensions. As is apparent from FIGS. 6 and 7, these enlargements 23', 23" fit into each other; their longitudinal extensions are dimensioned such that the longitudinal displacement of the oppositely movable supporting members 18', 18" will not be impeded.

Laterally beside each of the longitudinal conveying means 15, 16 arranged on the feed sides 7, a fixed hearth 26 is provided, which is comprised of deposit trestles 27 made of refractory material and consecutively arranged in the longitudinal direction of the furnace 6. The thin slabs 5 introduced into the furnace may be deposited on these trestles 27, wherein it is also possible to stack the thin slabs 5 on the trestles 27 one above the other in case of a standstill of the rolling mill, as will be explained below. The extension of the deposit trestles 27 in the transverse direction of the furnace 6 approximately corresponds to the maximum width of a strand to be cast on the continuous caster 3. The deposit trestles 27 also could be configured twice as wide in order to be able to receive, for instance, two adjacent slabs 5.

A lifting means 28 serves to convey the thin slabs from the feed side 7 to the fixed hearth 26 and from the fixed hearth 26 to the delivery side 8, which lifting means is displaceable along rails 29 transverse to the longitudinal axis 19 of the furnace 6 above the furnace roof 13. This lifting means 28 comprises grapplers 30 projecting through the furnace roof 13 into the interior 17 of the furnace, which are distributedly or serially arranged in the longitudinal direction of the furnace 6 in any required number depending on the thickness of the thin slabs 5. Two grapplers 30 each are arranged symmetrical and are movable towards each other to clamp the thin slabs 5 by means of jaws 32 engaging at the longitudinal edges 31 of the slabs. Furthermore, the liftable and lowerable grapplers 30 can be lifted into a resting position A (dot-and-dash position in FIG. 4), in which the jaws 32 of the grapplers 30 are retracted in a recess 33 provided in the furnace roof 13. This recess is delimited by a jacket 34 provided with a liquid cooling. It would also be possible to provide the grapplers 30 with an internal cooling, in which case no recess 33 is needed.

A securing hook 35 is articulately fastened to the lower end of each grappler 30, the articulation being located outside of the furnace space 17 and designed as a linkage parallelogram. The grappler 30 forms the web of the linkage parallelogram fastening and the securing hook 35 its coupler. The oscillating cranks are formed by brackets 36 hinged to the grappler 30 on one end and to the securing hook 35 on the other end. With the grappler 30 being freely in space, the securing hook 35, by its hook end 37, reaches below the jaw 32 of the grappler 30 contacting a longitudinal edge 31 of the slab and underlaps the same by a slight extent.

Each securing hook 35 comprises a supporting nose 38, which projects into a corresponding recess 39 of the grappler with the securing hook lowered (cf. FIG. 8), a downwardly oriented supporting surface 40 of the supporting nose 38 contacting a counter surface 41 of the recess, absorbing vertical forces. Thereby, the joints of the articulations of the securing hooks 35 are largely relieved in case of stress.

As is apparent from FIG. 9, the securing hooks 35 automatically get into a releasing position as a thin slab 5 is deposited on an equally wide or slightly wider thin slab, residing laterally of the ends of the grapplers 30. When lifting the grapplers 30, the securing hooks 35 automatically pivot back into the position represented in FIG. 8.

FIG. 3 depicts a way of sealing the recesses provided in the furnace roof 13 for the grapplers 30 and configured as slots 42 extending over the entire furnace width. When moving the lifting means 28, the grapplers 30 move along these slots 42, because they extend therethrough, one pair of grapplers each passing one of the slots 42. Channels 44 filled with liquid 43, such as water, each are provided parallel to a slot 42 one on either side of the slot 42. These two channels communicate with each other on both slot ends such that the liquid 43 surrounds the slot 42 as a closed ring.

The ends of the grapplers 30 outside of the furnace each are fastened to a cross beam 45 extending transverse to the slot and forming a T with the part of the grappler 30 that passes through the furnace roof 13. Perpendicularly downwardly extending U-shaped struts 46 are fastened to the ends of this cross beam 45 by their inner legs 47. The outer legs 48, which exceed the inner legs 47 in terms of length are fastened to a common cross beam 49. This cross beam 49, which extends parallel to the lower cross beam 45, is mounted within the lifting means 28 so as to be liftable and lowerable and, for seizing the slab edges, displaceable or pivotable in the transverse direction, and is movable over the length of the slot 42 commonly with the lifting means 28.

The U-shaped struts each protrude into one of the channels 44 extending along the slot 42. A bell 50 extending over the entire moving path of the lifting means 28 is stationarily arranged between the two cross beams 45 and 49 in terms of height, its lower end projecting into the channels 44 between each of the two legs 47, 48 of the U-shaped struts. The bell 50 is designed to be closed to a ring on the longitudinal side walls 11 of the furnace 6 such that no furnace air may escape outwards through the slot 42.

According to the embodiment illustrated in FIGS. 4 and 5, each grappler 30 is surrounded by a sleeve 51 outside of the furnace 6, which allows for a minor transverse movement of the grapplers 30 for the purpose of seizing the edges 31 of the thin slabs, yet is moved with the lifting means 28 and, thus, with the grapplers 30 as the lifting means is displaced along the slot 42. The upper end of the sleeve is surrounded by a channel filled with liquid 43, into which a bell 52 arranged on the grappler 30 is immersed.

The lower end of the sleeve 51 is tightly inserted in a sealing strip 53 extending transverse to the sleeve 51, which sealing strip extends transverse to the longitudinal direction of the furnace, i.e., in the moving direction of the lifting means 28, over the entire length of the slot 42. This sealing strip 53 lies in a displacement channel 54 extending over the entire furnace width and rests on bearing surfaces 55 of this displacement channel 54 by its longitudinal edge regions. The sealing strip 53 is pressed at these bearing surfaces 55 by means of sealing ledges 56 extending along the displacement channel 54 and, on the ends of the displacement channel 54, even transverse to the same, the bearing surfaces 55 likewise extending transverse to the displacement channel 54 on the ends of the same. A sealing liquid 43, such as water, is filled between the sleeve 51 and the sealing ledges 56.

When moving the lifting means 28, the sealing strip 53 is displaced between the bearing surfaces 55 and the sealing ledges 56 such that the slot 42 of the furnace roof 13, through which the grapplers 30 pass, always will be covered by the sealing strip 53. In order to collect leakage liquid penetrating between the sealing ledges 56 or the bearing surfaces 55 and the sealing strip 53, an additional channel 57 is provided below the displacement channel 54, including a central slot-shaped passage opening 58 upwardly extending the slot 42 of the furnace roof 13, through which the grapplers 30 pass. The leakage liquid is discharged from this channel 57 via a discharge duct 59 and is returned to the displacement channel 54 via a supply duct 60.

The sealing strip 53 is flexible and preferably designed as a metal strip (chromium-nickel steel). In order not to require any space laterally of the furnace 6 when displacing the lifting means, its ends can be wound on and off drums 61 arranged at the vertical longitudinal side walls 11 of the furnace 6.

Figure 2:
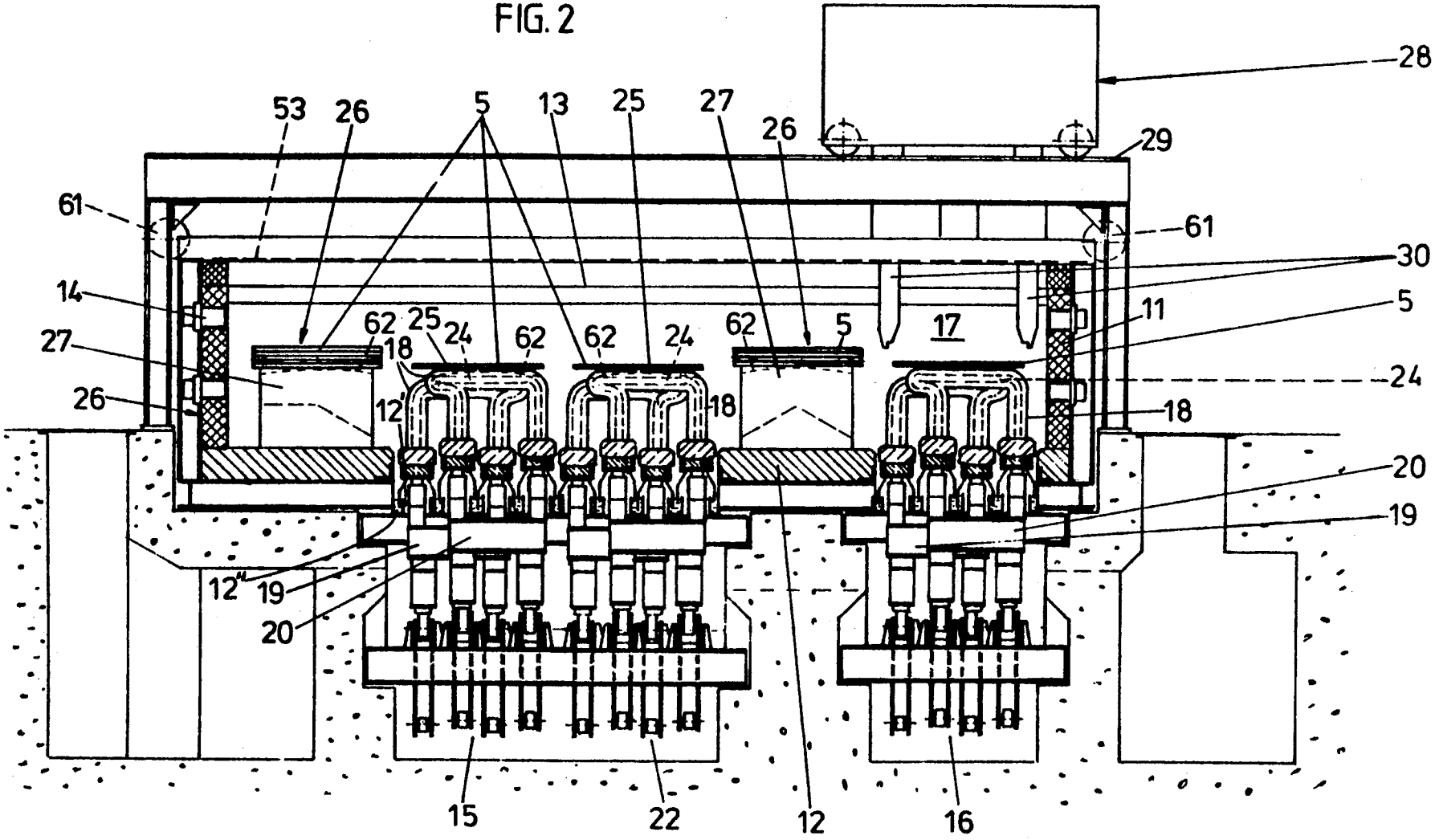
FIG. 2 is a section along line II—II of FIG. 1.

In order to ensure the safe seizure of particularly slim thin slabs and to prevent them from sagging and, thus, slipping when clamped between the grapplers 30, the bearing surfaces on the supporting members 18 and on the fixed hearth 26, according to a preferred embodiment, are curved upwardly (cf. the broken lines 62 of FIG. 2) such that the thin slabs 5 also will bend upwardly. They can then be seized by the grapplers 30 in the upwardly bent state.

According to the variant illustrated in FIG. 10, the furnace 6', on its feed side, is equipped with a preheating chamber 63 such that the end of the thin slab 5 entering the furnace 6' last is allocated a residence time within the furnace 6' that suffices to bring to rolling temperature even this end or to obtain a temperature equalization on this end.

During normal operation, a thin slab 5 is deposited from the feed side 7 onto the neighboring fixed hearth 26. After having been lifted from the feed side 7, the consecutive thin slab 5 can be conveyed in. After some time, during which the temperature equalization and the heating of the first thin slab 5 to rolling temperature have been effected, the thin slab 5 introduced first is moved to the delivery side 8 by the lifting means 28 and from there to the roller table 9 of the rolling mill by the walking beam conveying means 22. After this, the next thin slab 5 is deposited from the feed side 7 onto the fixed hearth 26.

As is apparent from FIG. 1, a separating means 4' is arranged at the beginning of the roller table 9 leading to the rolling mill 10, which may be required for emergency situations.

The furnace 6 or 6' need not be provided to directly follow the continuous caster 3. Various means may be provided between the run-out roller table 1 of the continuous caster 3 and the feed side 7 of the furnace 6, 6', such as, for instance, a descaling means, a thickness measuring means, etc. Nor is it necessary for the roller table 9 leading to the rolling mill 10 to directly follow upon the delivery side 8 of the furnace 6, 6'. It is, for instance, possible to convey the slabs 5 from the continuous caster 3 to the furnace 6 and from the furnace 6 to the rolling mill 10 by transporting means other than a roller table.

The furnace 6, 6' also may serve to preheat or temperature-equalize slabs coming from two or more continuous casters, which continuous casters, in turn, may be designed as single- or multi-strand continuous casters.

What I claim is:

1. In a continuous slab caster arrangement followed by a rolling mill, of the type including a run-out roller table including a strand separating means and a furnace arranged between said strand separating means and said rolling mill, said furnace having a furnace roof, a furnace interior, a feed side through a transverse wall of said furnace and a delivery side and being equipped with a first longitudinal conveying means arranged on said feed side, a second longitudinal conveying means arranged on said delivery side and including a slab storage place located parallel to said longitudinal conveying means, and a transverse conveying means for conveying a slab from said first longitudinal conveying means to said second longitudinal conveying means, the improvement comprising at least one fixed hearth arranged within said furnace parallel to said longitudinal conveying means and having a minimum width adapted to the width of a slab and adapted to receive a plurality of slabs stacked one above the other, and a lifting means forming said transverse conveying means and projecting through said furnace roof into said furnace interior, said lifting means being displaceable from a position above said longitudinal conveying means into a position above said fixed hearth and from a position above said fixed hearth into a position above said longitudinal conveying means, said lifting means further comprising a plurality of serially arranged grapplers disposed along the length of said furnace.

2. An arrangement as set forth in claim 1, wherein said plurality of grapplers are provided with jaws adapted to seize said slabs on their longitudinal edges.

3. An arrangement as set forth in claim 2, wherein each of said grapplers is sealed relative to said furnace roof by a liquid seal.

4. An arrangement as set forth in claim 2, wherein a recess is provided in said furnace roof constituting a resting position to said grappler, said grappler being retractable into said recess.

5. An arrangement as set forth in claim 4, further comprising a cooling liquid jacket surrounding said recess.

6. An arrangement as set forth in claim 2, further comprising a sleeve arranged above said furnace roof to enclose said grappler and having an upper end provided with a liquid seal, a bell engaging at said grappler being immersed in said liquid seal, a sealing strip extending transverse to said sleeve and tightly receiving said sleeve by its lower end, a displacement channel arranged along the moving path of said lifting means and accommodating said sealing strip, supporting surfaces provided in the longitudinal direction of said displacement channel and extending transverse to said displacement channel on the ends of said displacement channel, sealing ledges extending along said displacement channel and transverse to said displacement channel on the ends of said displacement channel, and a drum provided on each end of said sealing strip, said sealing strip having longitudinal side edge regions resting on said supporting surfaces and being pressed at said supporting surfaces by said sealing ledges, and wherein said sealing strip is displaceable between said sealing ledges and said supporting surfaces during movement of said lifting means, each of its ends being windable on and off said drum.

7. An arrangement as set forth in claim 6, wherein said sealing strip is comprised of a metal strip.

8. An arrangement as set forth in claim 6, further comprising a further channel provided below said displacement channel, which further channel includes a central slot-shaped passage opening for said grapplers to pass therethrough to receive leakage liquid.

9. An arrangement as set forth in claim 1, wherein said longitudinal conveying mean are comprised of walking beam conveying means.

10. An arrangement as set forth in claim 9, wherein said walking beam conveying means are equipped with internally cooled supporting members projecting into said furnace interior.

11. An arrangement as set forth in claim 10, wherein said supporting members extend transverse to the transport direction over approximately the entire width of said slab and are equipped with projections extending in the transport direction and each engaging between projections of the neighboring one of said supporting members during mutual approachment of said supporting members.

12. An arrangement as set forth in claim 10, wherein said supporting members extend in the transport direction and are equipped with enlargements provided transverse to the transport direction, enlargements provided between neighboring ones of said supporting members being spaced apart.

13. An arrangement as set forth in claim 2, further comprising a securing hook hinged to each grappler and including a hook end, said securing hook assuming a resting position with said grappler being in a position free in space, in which resting position said hook end projects to below said jaws of said grappler seizing said longitudinal edges of said slab and engages said longitudinal edges of said slab from below.

14. An arrangement as set forth in claim 13, further comprising a linkage parallelogram for hinging said securing hook to said grappler, said linkage parallelogram including a web formed by said grappler and a coupler formed by said securing hook.

15. An arrangement as set forth in claim 13, wherein said securing hook comprises a supporting nose and said grappler includes a corresponding recess to receive said supporting nose in the resting position of said securing hook, said recess having a recess surface engaging said securing hook and absorbing vertical forces and said supporting nose having a corresponding supporting surface contacting said recess surface.

16. An arrangement as set forth in claim 1, further comprising upwardly curved slab support means provided on said longitudinal conveying means and on said fixed hearth in the transverse direction thereof.

17. An arrangement as set forth in claim 1, further comprising a preheating chamber arranged in said furnace on its feed side forward of the transverse wall of said furnace.

* * * * *